United States Patent [19]

Nolan et al.

[11] 3,948,152

[45] Apr. 6, 1976

[54] CARTON MANUFACTURE

[75] Inventors: James Anthony Nolan; Howard Tonge, both of Louth, England

[73] Assignee: Charles Baron, Louth, England

[22] Filed: July 22, 1974

[21] Appl. No.: 490,729

[30] Foreign Application Priority Data

July 27, 1973 United Kingdom..... 35939/73

[52] U.S. Cl...... 93/49 M; 53/382; 93/41.1; 93/52

[51] Int. Cl.²..... B31B 1/36; B31B 1/68

[58] Field of Search..... 53/374, 382; 93/52, 49 M, 93/49 R, 41, 41.1, 48, 56 R, 1 F

[56] References Cited

UNITED STATES PATENTS

| | | | |
|---|---|---|---|
| 2,987,973 | 6/1961 | Chandler | 93/52 |
| 2,997,833 | 8/1961 | Nigrelli et al. | 53/382 |
| 3,039,370 | 6/1962 | VanHouden King, Jr. et al. | 53/374 X |
| 3,199,262 | 8/1965 | Miller et al. | 93/56 R |
| 3,439,588 | 4/1969 | Taylor et al. | 93/41 X |
| 3,477,349 | 11/1969 | Berney | 53/382 X |

*Primary Examiner*—James F. Coan
*Attorney, Agent, or Firm*—Garrettson Ellis

[57] ABSTRACT

A machine for joining together two overlapping opposite flaps of the carton comprising a stitching head and conveyor means for moving the carton past the stitching head to form a row of stitches to effect the join, a mandrel against which the stitching is effected, and guide means directing the flaps in overlapping relation on to the mandrel as the carton is conveyed past the head.

14 Claims, 7 Drawing Figures

CARTON MANUFACTURE

This invention relates to carton manufacture and is particularly concerned with stitching or otherwise joining together two opposite flaps of a rectangular or square carton to define, for example, the bottom of the carton.

The objects of the invention are to provide an improved method of and an improved apparatus for joining together two flaps of a carton.

In accordance with this invention there is provided a method of joining together two flaps of a carton comprising moving the carton along a given path in which path is provided mandrel, deflecting the flaps into overlying relationship on the mandrel, and joining the flaps by operation of a head which effects the join with application of pressure against the mandrel.

The invention also resides in apparatus for joining together two flaps of a carton, the apparatus comprising a conveyor means for moving a carton along a given path, a mandrel positioned in said path, guide means for directing two flaps of the carton in overlying relationship on the mandrel, and a head positioned above the mandrel and operative to effect joining of the flaps with application of pressure against the mandrel.

The head is preferably a stitching head which inserts staples in the flaps and turns over the staple ends against the mandrel. The head may, however, apply an adhesive tape, or adhesive may be applied where the flaps overlap and the head may merely apply pressure.

The invention is described with reference to the accompanying drawings, wherein.

Figure 1:
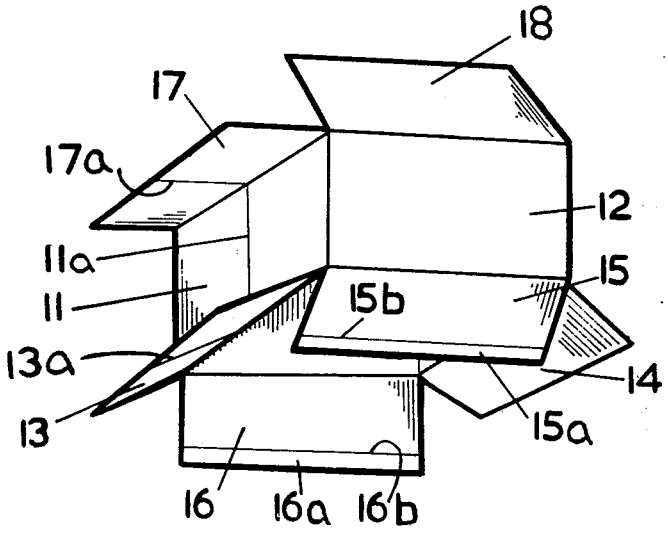
FIG. 1 is a perspective view of a carton shown partially assembled before a stitching operation.

In general, cartons have been supplied as blanks having cuts and creases in them to permit folding of the blanks to form the carton and the assembly of the carton is undertaken by the users. This is clearly advantageous to facilitate transport, but from the user's point of view, ease of assembly is of great importance. Collapsible cartons have been manufactured, in which some stitching is carried out by the manufacturer, the carton being such that it collapses to a flat condition, but can readily be opened out for use. Such a carton is shown in FIG. 1, the carton having four side walls, only two of which, referenced 11 and 12, are visible in FIG. 1. The carton has a bottom formed from two opposite inner flaps 13, 14 and two opposite outer flaps 15, 16, each flap being hinged to a respective side wall, and similarly, the carton has two inner top flaps (only one, referenced 17, shown) and two outer top flaps (only one, referenced 18, shown) forming a top closure for the carton. Each bottom outer flap 15, 16 has a margin 15*a*, 16*a*, defined by a longitudinal fold 15*b*, 16*b*. Two opposite side walls also have folds extending depthwise of the box, as shown at 11*a*, and these folds are continued along the adjoining flaps, as shown at 17*a* and 13*a*.

To prepare the carton for sale, the bottom inner flaps 13, 14 are first folded inwardly to lie on the adjoining side wall and the two bottom outer flaps 15, 16 are then folded inwardly substantially into alignment with the margins 15*a*, 16*a* in overlapping positions. The margins are then stitched together. To collapse the carton, the stitched flaps 15, 16 are folded inwardly between the side walls along the folds 15*b*, 16*b* and the side walls and flaps, such as 11, 13 and 17, having the folds, such as 11*a*, 13*a*, 17*a*, are folded outwardly along these folds: The top flaps, such as 17 and 18, are also folded inwardly between the side walls before the latter two folding operations.

Cartons of this type have been manufactured wherein the stitching operation has been carried out manually, using a stitching machine. This results in high labour costs and also in many reject cartons, because the positioning of the stitching is critical to permit the carton to fold for collapsibility and it is difficult both to hold the carton and stitch correctly. The apparatus described below enables these disadvantages to be avoided, although it will be appreciated that the apparatus can be used for stitching other types of cartons.

Figure 2:
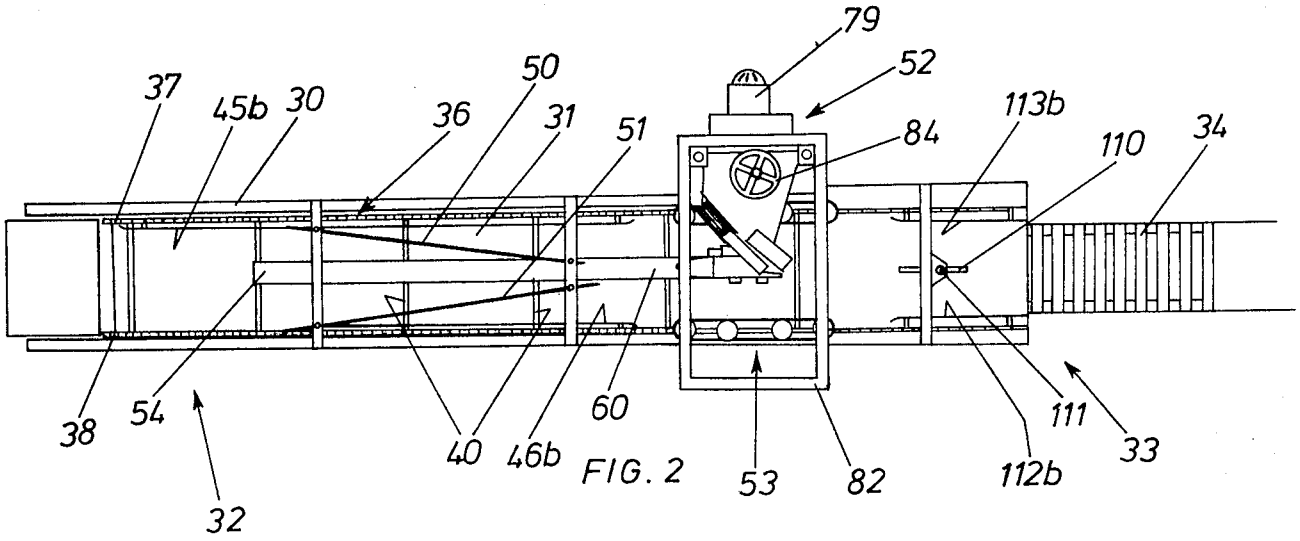
FIG. 2 is a plan view of apparatus for stitching together flaps of the carton.
Figure 3:
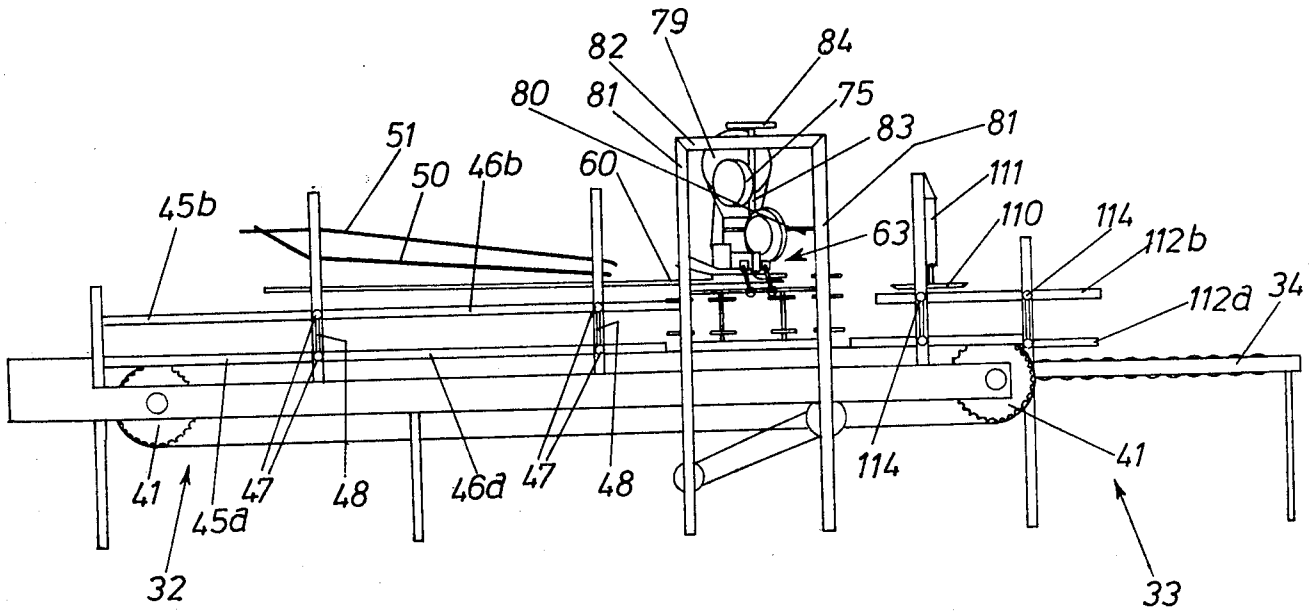
FIG. 3 is a side elevation of the apparatus of FIG. 2.

Referring now to FIGS. 2 and 3, the apparatus shown comprises a frame 30 mounting on elongate bed 31 having a smooth upper surface for the sliding of cartons therealong. The apparatus includes an input station 32 where cartons are fed onto the bed. In this particular example, the cartons are individually placed manually on the bed, but it will be appreciated that the cartons may be fed from a conveyor to the input station. At the opposite end of the bed 31 is provided an output station 33 where there is provided an output conveyor 34, which comprises a plurality of rollers.

Between the input station and the output station are provided deflector bars 50, 51, a stitching unit 52 and an accelerating device 53 and a main conveyor 36 is provided to move cartons along the bed 31 from the input station to the output station.

The main conveyor 36 comprises two continuous roller chains 37, 38, one at each side of the bed. Each roller chain is of conventional construction and comprises a multiplicity of spaced rollers pivotally interconnected by links. The two roller chains are interconnected by longitudinally spaced lateral conveyor bar 40. The chains 37, 38 are driven by respective sprockets, such as 41, connected with an electric motor (not shown). The chains ride on the marginal edges of the bed so that the bars sweep along the top of the bed, slightly spaced above the bed.

From the input station 32, opposite pairs of guide bars 45*a*, 45*b* and 46*a*, 46*b* respectively are provided, extending lengthwise of the bed to locate cartons between the roller chains 37, 38. One pair of guide bars 46*a*, 46*b*, is shorter than the other pair of guide bars 45*a*, 45*b* to facilitate access from the side of the apparatus for the placing of cartons on the bed 31 at the input station 32. Both pairs of guide bars are adjustable laterally of the bed by means of screws 47 carrying nuts (not shown) and the screws mounting the upper guide bars 45*b*, 46*b* are received in elongate slots 48 in the frame for vertical adjustment.

The deflector bars 50, 51 are located above the guide bars and converge along the bed 31 away from the input stations 32 as viewed in plan (FIG. 2). The deflector bars also converge in the same direction as viewed in side elevation (FIG. 3). A separator bar 54 extends parallel to the bed 31 beneath the deflector bars 50, 51 and the deflector flaps serve to fold, one upon the other, the two flaps of the carton to be stitched, the separator bar 54 serving to hold down other flaps of the carton, as described more fully hereinafter.

The separator bar 54 is substantially co-planar with a mandrel 60 and in this embodiment integral with the mandrel 60. The mandrel forms a part of the stitching unit 52 and is most clearly shown in FIG. 4. The mandrel includes a working section 61 which lies beneath the stitcher 62 of a stitching head 63. A first guide plate 64 is welded to the mandrel so as to overlie the latter and define a slot 65 and a flexible, lead-in first deflector plate 66 is fixed to the first guide plate 64. A second guide plate 68 overlies the first guide plate to define a slot 69 and this second guide plate is fixed to a flexible, lead-in second deflector plate 70. The first and second guide plates terminate short of the working section 61 and serve to present the flaps to be stitched to the stitcher 62 in close overlying relationship.

The mandrel 60 is carried by a sub-frame 71 having an elongate, vertical slot 72 and the sub-frame is mounted on the stitching head 63 by a bolt 73 engaged in the slot 72 whereby the mandrel is adjustable with respect to the stitcher.

The stitching head 63 is of conventional form and is readily commercially available. The particular head shown is manufactured by Vickers Limited. The head includes (FIG. 3) a reel 75 of wire and an operation, the head cuts off individual lengths of wire and bends them to form staples of U-form. These staples are inserted through the flaps of the carton and the extreme ends are inturned against the mandrel to stitch the flaps together. The head includes its own drive motor 79.

The stitching head 63 is carried by a carriage frame 80 mounted for sliding vertical adjustment on pillars 81 of an upright frame section 82 of the frame 30. The head 63 is carried by a screw 83 engaged in the upright frame section and rotatable by a wheel 84. By this means, the height of the stitching head above the bed 31 is adjustable.

Figure 5:
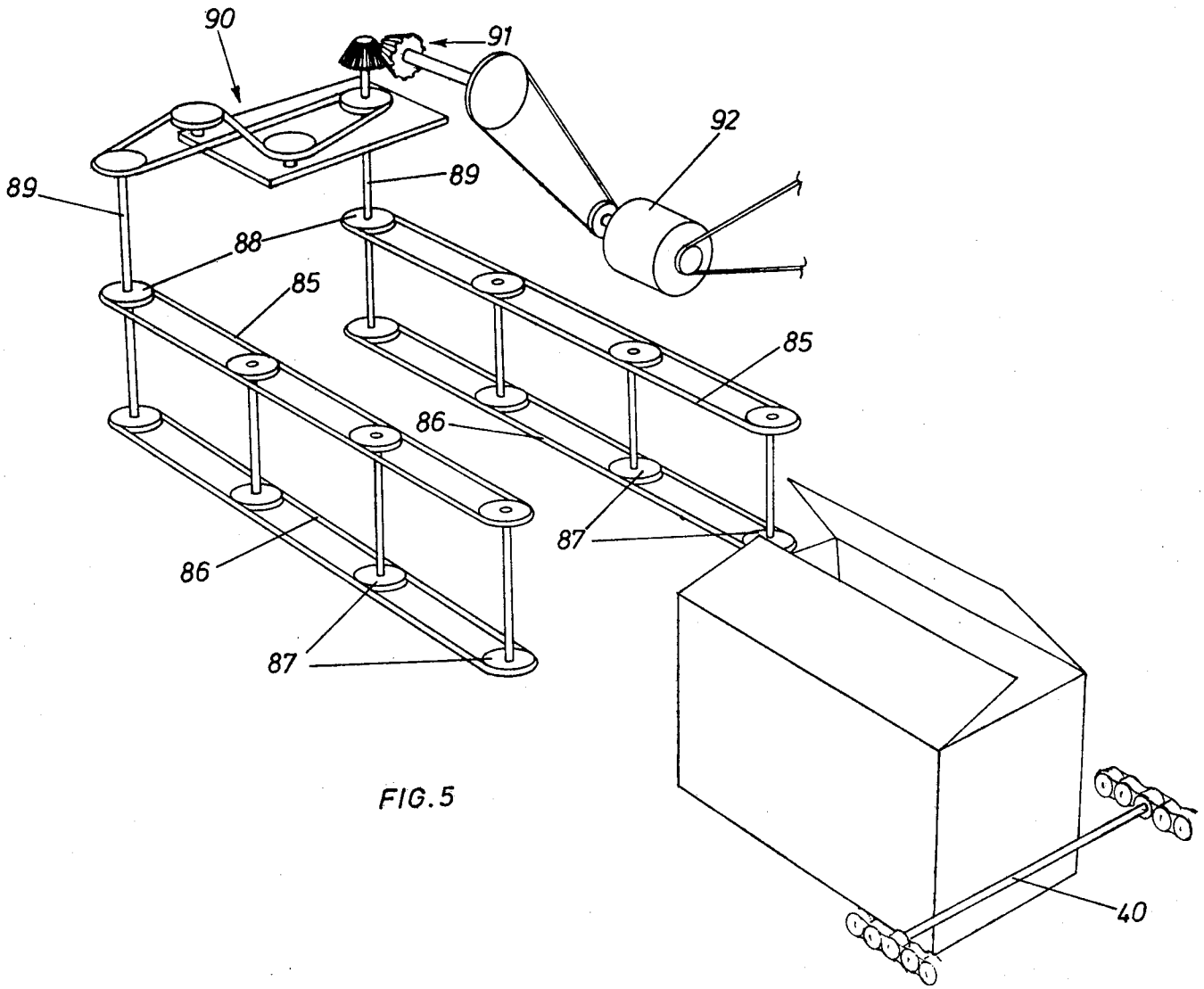
FIG. 5 is a diagrammatic perspective view of a friction drive of the apparatus.

While stitching is effected, the carton being stitched is momentarily stationary and the accelerating device 53 is provided to move the carton away from the conveyor bar 40, urging it along the bed, for the stitching period. The accelerating device 53 is most clearly shown in FIG. 5 and comprises upper and lower continuous friction belts 85, 86 respectively, at each side of the bed 31. The belts are supported by idler pulleys 87 and driven pulleys 88. The driven shafts 89 are connected by a series of pulleys 90 and gears 91 with a variable speed regulator 92, in turn driven from the same motor (not shown) that drives the roller chain conveyor 36. The pulleys 87, 88 supporting the friction belts are preferably mounted on sub-frames (not shown) for adjustment laterally of the bed 31 by screws (not shown) in a manner similar to that described with respect to the guide bars 45*a*, 45*b*, 46*a*, 46*b*.

The operation of the stitching head is controlled by a circuit including two micro-switches 100, 101 (FIG. 4) whose operating arms 102, 103 are biased downwardly by gravity, possibly assisted by springs. The arms 102, 103 are spaced, one each side of the working section 61 of the mandrel 60 for contact by a carton passing along the mandrel. The stitching head operates intermittently at high speed, but only operates when both micro-switches are closed by upward deflection of the arms 102, 103.

Between the stitching unit 52 and the output conveyor 34 is mounted a folding bar 110, preferably of V-section outline, carried by a fluid-pressure operated ram 111 for vertical reciprocation of the folding bar 110. The ram is preferably pneumatically operated and is electrically controlled by a micro switch (not shown). Output guides 112*a*, 112*b*, 113*a*, 113*b* are provided to guide the cartons past the folding bar 110 and these bars are vertically and laterally adjustable by screws 114.

Figure 6:
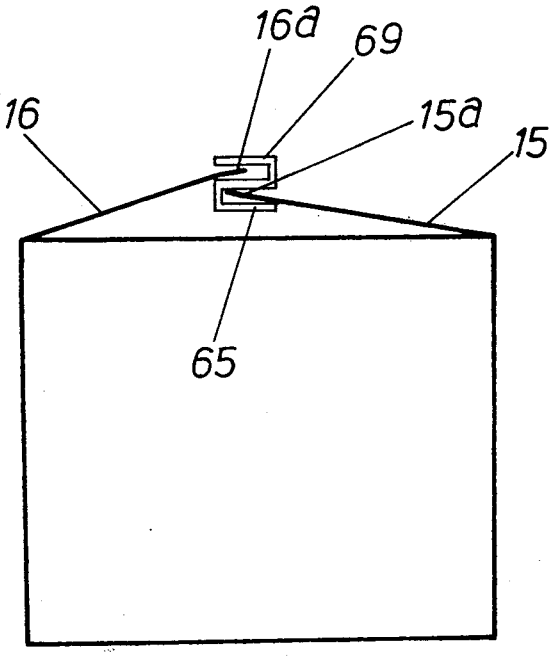
FIG. 6 is a diagrammatic sectional view, showing a carton on the mandrel.
Figure 4:
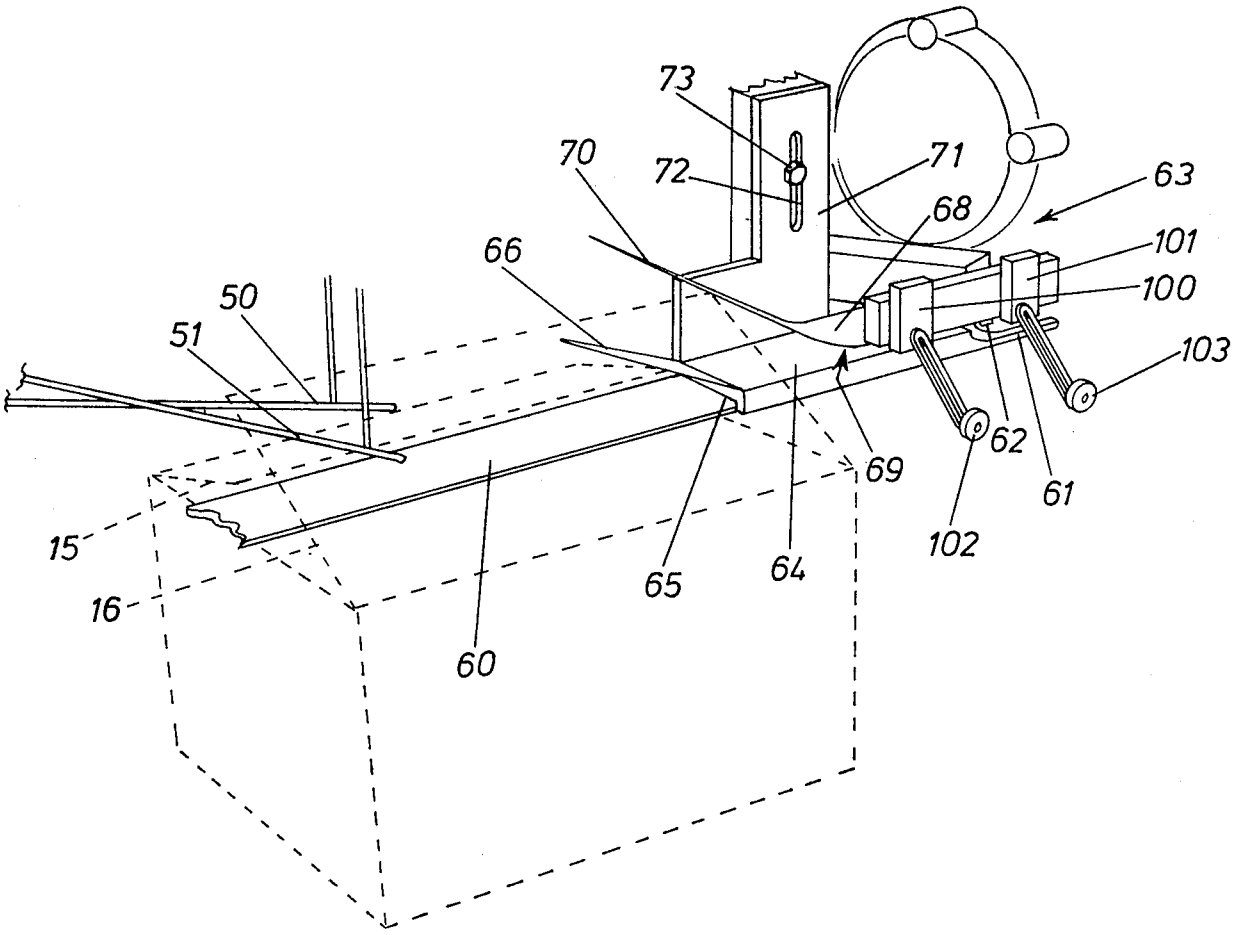
FIG. 4 is an enlarged perspective view of a part of the apparatus showing a mandrel and part of a stitching head.

In operation of the apparatus, a carton as shown in FIG. 1 is placed on the bed 31 at the input station 32, whilst the main conveyor 36 is operating. The carton is positioned in parallelepiped form with the bottom outer flaps 15, 16 uppermost and with the bottom inner flaps 13, 14 inturned. A conveyor bar 40 engages the carton and carries it along the bed 31 where it engages the guide bars 45*a*, 45*b*, 46*a*, 46*b* for lateral guidance. The carton passes beneath the separator bar 54, which holds down the bottom inner flaps 13, 14 and the bottom outer flaps then engage the deflector bars, which progressively deflect these flaps downwardly, the flaps engaging the deflector bar 50 being deflected beneath the flaps engaging the deflector bar 51. Referring particularly to FIG. 4, the flaps then engage beneath respective guide plates 66, 70. The flaps are guides beneath these guide plates by the deflector bars 50, 51 before the carton has passed the deflector bars, the inherent resilience of the carton ensuring that the flaps do not fall below the guide plates. The flaps 15, 16 are then brought into close overlying relationship over the working section 61 of the mandrel for stitching by passage through the slots 65, 69, as shown in FIG. 6.

Before the flaps pass over the working section 61 of the mandrel, the carton is accelerated by the friction belts 85, 86 ahead of the bar 40 of the main conveyor. The carton deflects the arms 102, 103 of the micro switches 100, 101 to operate the stitching head when both micro switches are actuated. Intermittent stitching then occurs as the carton is transported past the stitcher 62, so that a row of stitches is provided to stitch together the flap margins 15*a*, 16*a*. Momentary stopping of the carton during stitching is permitted by slip between the friction belts and the carton. The stitcher ceases to operate as soon as the carton has passed the first micro switch arm 102 and released the latter. The stitches 120 are shown in FIG. 7.

Figure 7:
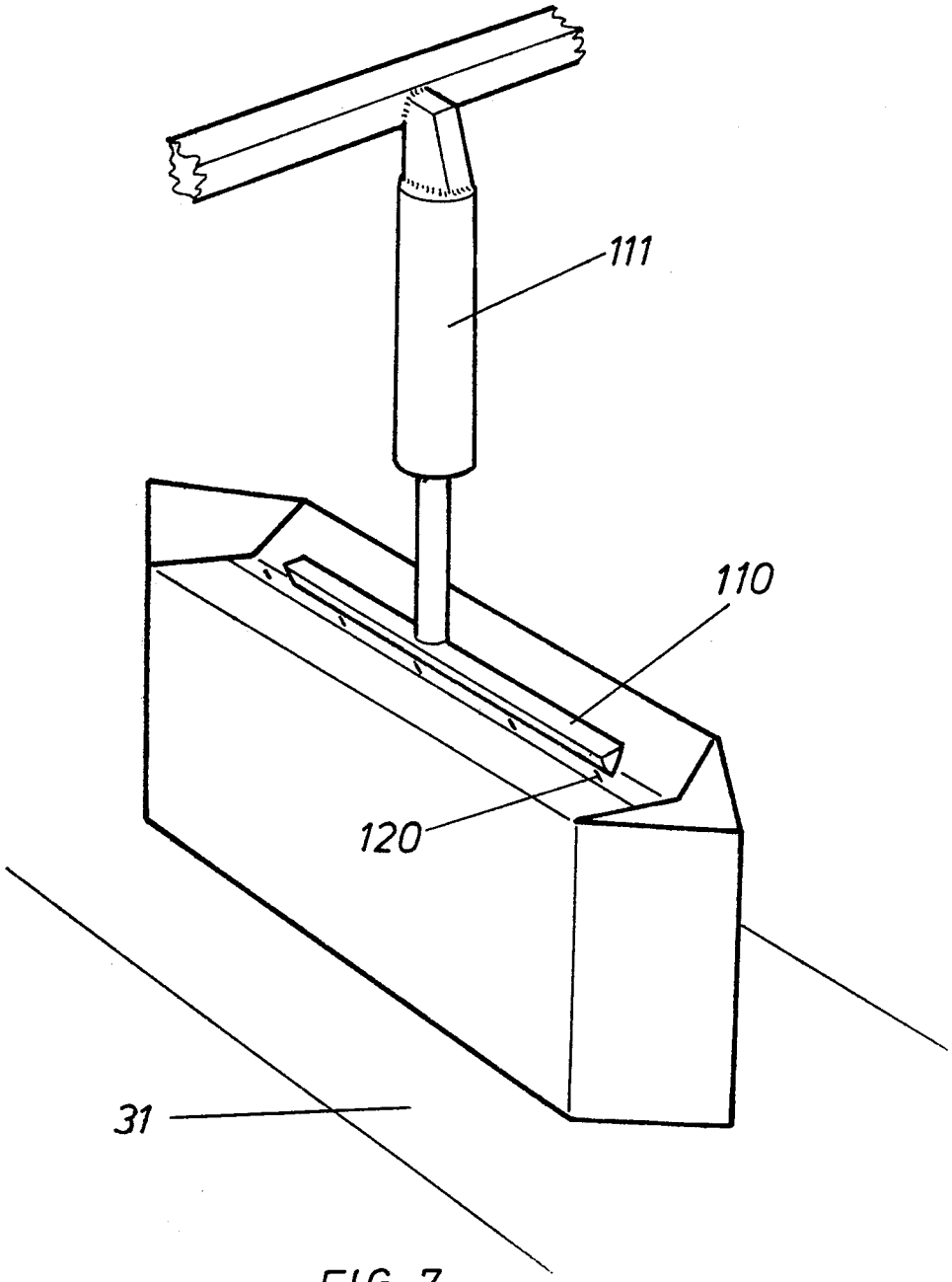
FIG. 7 is a diagrammatic perspective view showing a partially collapsed, stitched carton and a folding member affecting said partial collapse.

Before the conveyor bar 40 re-engages the carton, the folding bar 110 is lowered to cause partial collapse of the box by depressing inwardly the stitched flaps 15, 16, as illustrated in FIG. 7. The partially collapsed carton is then re-engaged by the conveyor bar 40 and carried onto the output conveyor 34 where its momentum causes it to be fed, for example, to a further conveyor.

The above described apparatus enables cartons to be stitched and partially collapsed very quickly and with accuracy. Full collapse is provided merely by applying pressure to the sides of the carton, whereby the cartons can be stacked and kindled.

It is envisaged that a further stage may be added to the apparatus at the input side to fold over the bottom inner flaps 13, 14, instead of this operation being carried out manually.

What we claim is:

1. Apparatus for joining together two flaps of a carton, the apparatus comprising a conveyer means for moving a carton along a given path, an elongate, stationary mandrel positioned in said path, said mandrel extending in longitudinal relation to said path, guide means for directing two flaps of the carton in overlying relationship on the mandrel, and a head positioned adjacent the mandrel and operative to effect joining of the flaps with application of pressure against the mandrel.

2. Apparatus according to claim 1 wherein the guide means include a first member defining a first slot between the first member and the mandrel for receiving one flap of the carton, and a second member defining a second slot above the first member for receiving the other flap of the carton.

3. Apparatus according to claim 2 wherein each slot has a flared entrance.

4. Apparatus according to claim 2 wherein the guide means includes a pair of spaced elongate deflectors lying along said given path, the deflectors being both horizontally and vertically convergent and serving to deflect corresponding flaps of the carton into overlying relationship.

5. Apparatus according to claim 1 wherein the head operates to exert pressure on the mandrel through the flaps intermittently, the head being electrically controlled and including two switches having actuators spaced along said given path, the head commencing operation only when both switches are closed and ceasing operation when one switch is open, the actuators being positioned for actuation by a carton moving along said given path.

6. Apparatus according to claim 5, wherein the head operates to exert pressure on the mandrel through the flaps intermittently, whereby the carton is intermittently stopped, the conveyor means including friction drive means for moving the carton permitting slip by the drive means whilst the carton is stopped.

7. Apparatus according to claim 6, wherein the friction drive means engages the carton whereby slip is permitted between the drive means and the carton.

8. Apparatus according to claim 1 wherein the conveyor means includes a bed along which the cartons are movable in said given path, a pair of spaced roller chains movable along said bed, and bars for engaging cartons to move them along the bed, the bars being connected between the roller chains.

9. Apparatus according to claim 5, wherein the head is a stitching head which is operable to insert staples in the flaps, the staples being turned over against the mandrel.

10. Apparatus according to claim 1 including a folding device for effecting partial folding of a carton after passage of the latter by the conveyor means past the head, the folding means being reciprocable vertically to effect inward depression of the interconnected overlying flaps.

11. Apparatus according to claim 1 wherein the guide means includes a pair of spaced, elongate deflectors lying along said given path, the deflectors being both horizontally and vertically convergent and serving to deflect corresponding flaps of the carton into overlying relationship.

12. A method of joining together two flaps of a carton comprising moving the carton along a given path, in which path is provided a stationary, elongate mandrel extending along said path, deflecting the flaps into overlying relationship on the mandrel as said carton is moved along the given path, and joining the flaps by operation of a head to effect the join by application of pressure against the mandrel.

13. Apparatus for joining together two flaps of a carton, the apparatus comprising a conveyor means for moving a carton along a given path, a mandrel positioned in said path, guide means for directing two flaps of the carton in overlying relationship on the mandrel, and a head positioned above the mandrel and operative to effect joining of the flaps with application of pressure against the mandrel, said mandrel being elongate and extending along said given path, said guide means including a first member defining a first slot between the first member and the mandrel for receiving one flap of the carton, said guide means also defining a second member defining a second slot above the first member for receiving the other flap of the carton, said guide means further including a pair of spaced elongate deflectors lying along said given path, the deflectors being both horizontally and vertically convergent and serving to deflect corresponding flaps of the carton into overlying relationship, in which said head is adapted to intermittently exert pressure on the mandrel through said flaps, whereby said carton is intermittently stopped in its motion along said given path, said conveyor means including friction drive means for moving the carton but permitting slippage by the drive means as the carton is stopped, said conveyor means including a bed along which the cartons are movable in said given path, a pair of spaced roller chains movable along said bed, and bars for engaging cartons to move them along said bed, said bars being connected between the roller chains.

14. Apparatus for joining together two flaps of a carton, the apparatus comprising a conveyer means for moving a carton along a given path, an elongate, stationary mandrel positioned in said path in longitudinal relationship thereto, guide means for directing two flaps of the carton into overlying relationship on the mandrel, and a head positioned adjacent the mandrel and operative to effect joining of the flaps with application of pressure against the mandrel, said guide means including a first member defining a first slot between the first member and the mandrel for receiving one flap of the carton, said guide means also defining in a second member a second slot above the first member for receiving the other flap of the carton, said guide means further including a pair of spaced, elongate deflectors lying along said given path, the deflectors being both horizontally and vertically convergent and serving to deflect corresponding flaps of the carton into overlying relationship, in which said head is adapted to intermittently exert pressure on the mandrel through said flaps, whereby said carton is intermittently stopped in its motion along said given path.

* * * * *